US005131866A

United States Patent [19]

Bodenweiser et al.

[11] Patent Number: 5,131,866

[45] Date of Patent: Jul. 21, 1992

[54] ELECTRICAL CONNECTOR

[75] Inventors: Clifford A. Bodenweiser, Berlin; Neil J. Woodward, Ayer, both of Mass.

[73] Assignee: Mod-Tap W. Corp., Harvard, Mass.

[21] Appl. No.: 815,549

[22] Filed: Dec. 27, 1991

Related U.S. Application Data

[63] Continuation of Ser. No. 609,909, Nov. 6, 1990, abandoned.

[51] Int. Cl.[5] ..... H01R 13/74

[52] U.S. Cl. ..... 439/532; 439/538

[58] Field of Search ..... 439/532, 536-540, 439/638; 379/332, 397

[56] References Cited

U.S. PATENT DOCUMENTS

| | | | |
|---|---|---|---|
| 4,274,702 | 6/1981 | Buck et al. | 439/888 |
| 4,303,296 | 12/1981 | Spaulding | 439/638 |
| 4,624,516 | 11/1986 | White | 339/40 |
| 4,712,232 | 12/1987 | Rodgers | 439/532 |
| 4,863,398 | 9/1989 | Steenton et al. | 439/538 |
| 4,875,880 | 10/1989 | Welch et al. | 439/536 |
| 4,909,757 | 3/1990 | Reed | 439/532 |
| 5,007,860 | 4/1991 | Robinson et al. | 439/540 |
| 5,013,260 | 5/1991 | Caveney et al. | 439/535 |
| 5,055,067 | 10/1991 | Field | 439/540 |

OTHER PUBLICATIONS

Brochure from MOD-TAP System Europe.
Brochure of Keptel, Inc.
Brochure of MOD-TAP System.
Brochure of AMP Incorporated, Harrisburg, Pa.
Brochure of Suttle Apparatus.

*Primary Examiner*—Gary F. Paumen
*Attorney, Agent, or Firm*—Hamilton, Brook, Smith & Reynolds

[57] ABSTRACT

An electrical connector comprises a C-shaped support member 26, and a cover or face plate 20. A pair of socket members 28 are arranged in the support member 26. The socket members are rotated about 90° with respect to prior art arrangements so that their longitudinal axes are substantially perpendicular to the longitudinal axis of the connector whereby socket density can be doubled.

6 Claims, 3 Drawing Sheets

ELECTRICAL CONNECTOR

This is a continuation of co-pending application Ser. No. 07/609,909 filed on Nov. 6, 1990, now abandoned.

FIELD OF THE INVENTION

This invention relates to electrical connectors in general and, in particular, to modular data communication connectors. The term data communication connectors as herein used means connectors for apparatus which receives signals transmitted over data communication lines such as facsimile machines, telephones, answering machines, computers, etc.

BACKGROUND OF THE INVENTION

In the field of communications wiring it has become accepted practice to adopt a modular approach where it is desired to wire a large number of installations. In a typical system, a number of cross connects and patch panels may be arranged in a distribution frame. From here, cabling is distributed to individual user locations. The present invention is directed to modular connectors which are to be employed at such locations.

An example of a prior art connector is shown in FIGS. 1(*a*) to (*d*). FIGS. 1(*a*) to 1(*d*) show, respectively, front, rear, side and end views of a prior art modular connector. This connector is one of a number which are snap-fitted into a mounting frame. In the figures, the connector is shown with its major axis $\alpha$ extending across the width of the page. It is to be understood that, in practice, such connectors are mounted with their major axes $\alpha$ extending vertically; in other words, perpendicular to the orientation shown in FIGS. 1(*a*) to 1(*d*).

The connector has a housing 1, the dimensions of which are standardized at 50 mm $\times$25 mm. The front 3 of the housing acts as a front plate. A socket 5 shaped to receive a data communication plug is located in the housing 1. The rear of the housing receives a moulded octagonal shroud 7 which carries snap connectors 9 on its short opposite sides 10. The width of the shroud 7 is equal to the width of the data communication socket 5 mounted therein. It will be noted that the longitudinal axis $\beta$ of the socket 5 extends in the same direction as the axis $\alpha$ of the housing 1. Thus, in practice with the housing 1 mounted in place on a vertically extending frame, plugs are inserted such that breadth extends perpendicular to the orientation of the frame; that is, the plug is inserted the right way up, i.e., vertically.

Although the prior art arrangement has proved satisfactory, it provides for a maximum connector density of one per 50$\times$25 mm connector unit. The present invention aims to provide a modular connector with an improved socket density because there is not room for more than one socket 5 side-by-side in the octagonal shroud 7.

SUMMARY OF THE INVENTION

In essence, the invention resides in the orientation of the socket openings on the connector unit. The sockets are arranged with their longitudinal axes extending substantially parallel to the longitudinal axis of the connector unit.

This arrangement has the advantage of allowing two sockets to be arranged side by side on one connector unit, so doubling the socket density having regard to the prior art construction.

More specifically, the invention provides a connector for telephone sockets and the like, the connector being adapted for mounting on a retaining member and comprising a support member, at least two socket members held in the support member, the support member being provided with an aperture through which wires can connect with the socket member and a cover member fastenable to the support member and having an aperture through which plugs can be engaged in a respective axes of the socket members, wherein the socket members are arranged on the support member with longitudinal axes of their socket openings extending in a direction substantially parallel to the longitudinal axis of the support member.

Preferably there are two socket members which abut each other in the support member.

Preferably the support member is a C-shaped channel and the socket members are rectangular, the walls of the channel abutting opposite ends of the socket members to retain the socket members therein.

Preferably, the cover member has a plurality of apertures equal in the number to the socket member.

The above and other features of the invention including various novel details of construction and combinations of parts will now be more particularly described with reference to the accompanying drawings and pointed out in the claims. It will be understood that the particular electrical connector embodying the invention is shown by way of illustration only and not as a limitation of the invention. The principles and features of this invention may be employed in varied and numerous embodiments without departing from the scope of the invention.

BRIEF DESCRIPTION OF THE DRAWINGS

FIG. 2(*b*) is a view similar to FIG. 2(*a*) with the front plate removed;

FIG. 2(*c*) is an end view of the connector of FIG. 2(*a*) with the front plate removed;

FIG. 2(*d*) is a view similar to FIG. 2(*c*) with the cover in place;

FIG. 2(*e*) is a side view with the cover removed;

FIG. 2(*f*) is a side view of the cover; and

DETAILED DESCRIPTION OF THE INVENTION

Figure 1A:
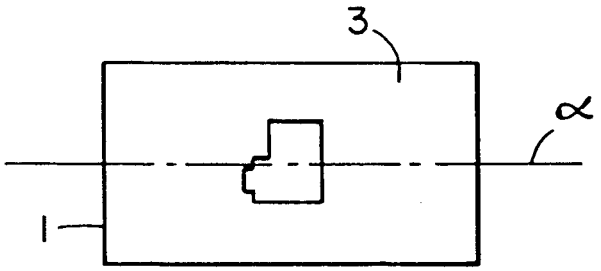
FIG. 1(a) PRIOR ART
FIGS. 1(*a*) to 1(*d*) show, respectively, front, rear, side and end views of a prior art modular connector.
Figure 1B:
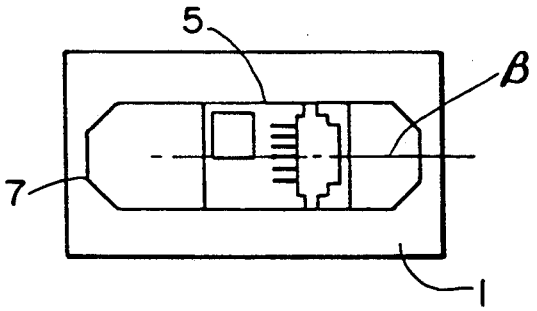
FIG. 1(b) PRIOR ART
Figure 1C:
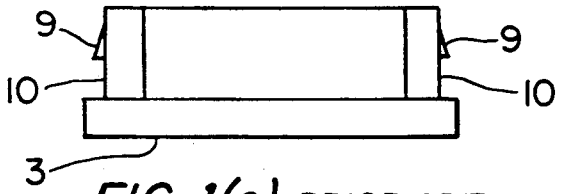
FIG. 1(c) PRIOR ART
Figure 1D:
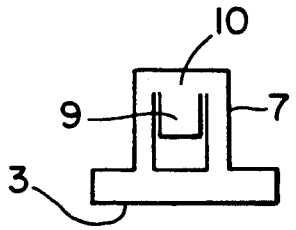
FIG. 1(d) PRIOR ART
Figure 2A:
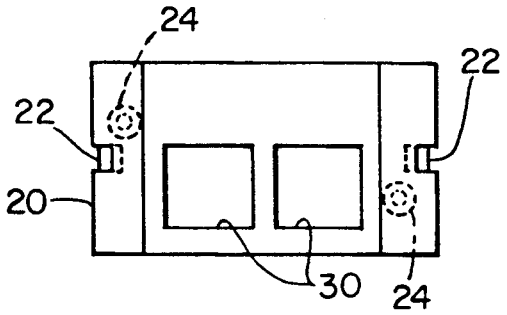
FIG. 2(*a*) is a top view of a connector embodying the invention.
Figure 2F:
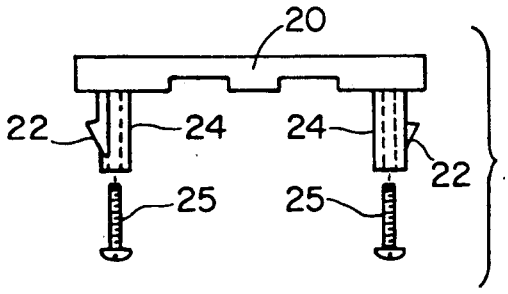
Figure 2B:
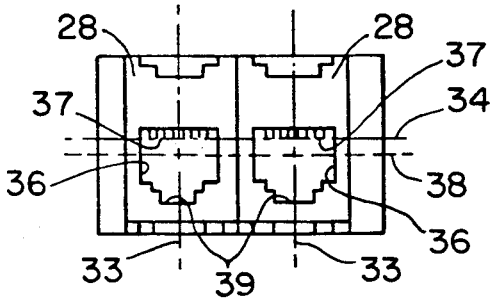
Figure 2C:
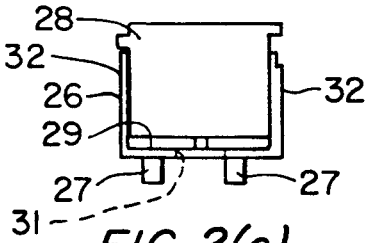
Figure 2D:
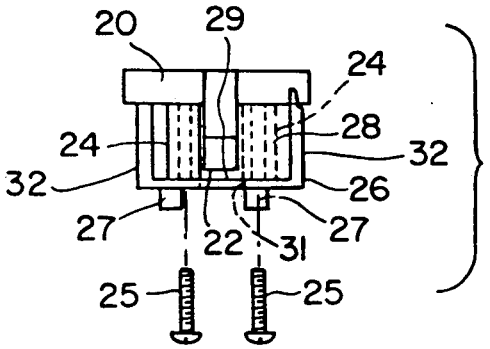
Figure 2E:
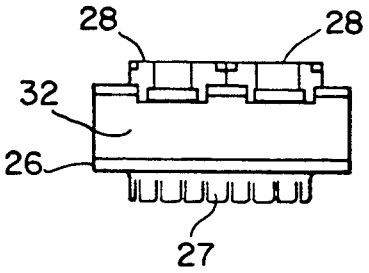

The connector comprises a face plate or cover 20 which carries snap locks or snap connectors 22 (FIGS. 2(*a*), 2(*d*) and 2(*e*)) and attachment posts 24; a socket support 26 and a pair of rectangular socket members 28. As an alternative, the snap locks or connectors 22 may be moulded as a part of the support member 26 as distinguished from projecting downwards from the cover 20 as seen in FIG. 2(*e*). The socket members 28 have socket openings 36 and are of a standard shape and size and may be, for example, a standard eight pin socket sold under various trade names and model designations. This embodiment is an example only.

Each socket opening 36, as seen in FIGS. 2(*b*), 3(*a*) and 3(*c*), exposes a row of electrical contacts 37. The socket openings 36 also each include a tab recess 39

(best seen in FIG. 2(*b*)) for receiving a latching tab of a conventional electric plug . . . .

The cover 20 is provided with a pair of apertures 30 (FIG. 2(*a*)) through which plugs are passed to engage in their respective sockets 28. There will obviously be as many apertures 30 as there are sockets 28 in the support member 26. The face plate 20 is attached to the socket support 26 by screws 25 (FIGS. 2(*d*) and 2(*e*) passed through apertures in the socket support and retained within the posts 24. Alternatively, the face plate 20 may be attached to the support 26 by welding or heat staking the posts 24 to the bottom 29 of the support 26. This would eliminate the need for the screws 25.

The socket support 26 is a C-shaped channel (see FIGS. 2(*c*) and 2(*d*)) and has side walls 32 within which the two sockets are held side by side with their sides abutting. The underside of the bottom 29 of the support 26 carries two rows of connecting tabs 27, one for each socket, each tab being wired to an individual input line which is then wired to the appropriate pin of the socket through an aperture 31 (FIG. 2(*c*)) in the support member. Suitable connectors for the tabs are well known, for example, the connector sold under the part number 110 C-4 by AT&T Corporation.

The chain dotted lines 33 in FIG. 2(*b*) represent the major axes of the assembled socket members 28. The major axes represented by the line 33 pass through the tab recesses 39 chain dotted line 34 represents the longitudinal or lateral axis of the channel or C-shaped support member 26. It will be seen the longitudinal axis 34 of the support member 26 (which is equivalent to that of the whole connector) is perpendicular to the major axis 33 of the socket members. Put another way, the width or side-to-side dimension of the socket members 28 in each socket support member 26, and the longitudinal axis 38 of each socket opening 36 are parallel to the longitudinal axis 34 of the support member.

It should be noted that the orientation of the socket opening 36 in the socket member 28 is perpendicular to that of the prior art described. In addition, the support 26 which corresponds to the shroud 7 in the prior art is no longer limited to the width of the socket. The effect of these variations is that it is now possible to fit two socket members 28 onto a single connector module which has the advantage of doubling socket density and so greatly reducing the overall size of the frame required to carry a given number of sockets.

Figure 3A:
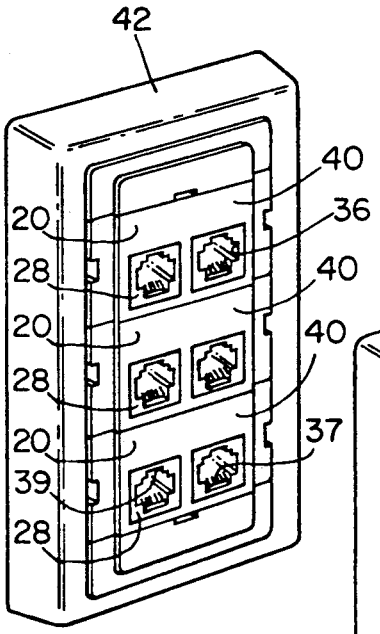
FIGS. 3(*a*), (*b*) and (*c*) show the connector embodying the invention incorporated in a wall plate.
Figure 3B:
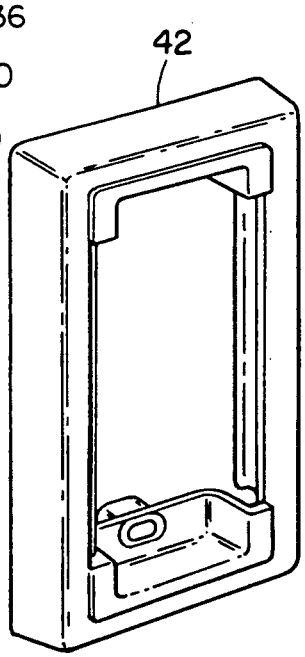
Figure 3C:
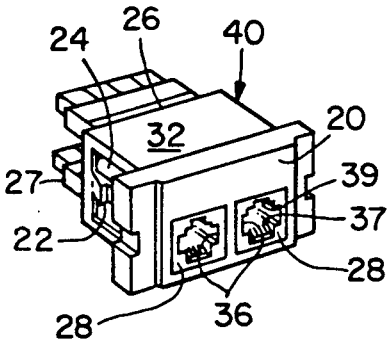

FIGS. 3(*a*) to 3(*c*) show three of the FIG. 2 connectors herein designated 40 assembled in a bezel 42 to produce an assembled wall plate as shown in FIG. 3(*a*) as will be seen in FIG. 3(*a*), the longitudinal axes of the connectors 40 are parallel to one another.

Although described with respect to a two socket arrangement, the invention could be applied to other sizes of connectors and carry any number of socket members. Whatever the number, the advantage of: increased density with respect to prior art arrangements, is always achievable.

We claim:

1. A modular connector for data communication sockets comprising:

A. a socket support in the form of a substantially C-shaped channel extending lengthwise along a longitudinal axis and having parallel side walls joined by a bottom;

B. at least two socket members located in the socket support;

C. each socket member having a major axis and a minor axis;

D. a socket opening in each socket member exposing a row of electrical contacts and including a tab recess for receiving a latching tab of an electrical plug, and through which recess the major axis of the socket member passes normal to the row of contacts; and E. each socket opening having a longitudinal axis parallel to the row of electrical contacts and formed at a 90° angle with the major axis of the socket member in which it is formed, such that when the socket members are assembled in side by side relationship in the socket support, the longitudinal axes of the socket openings are in alignment with each other and parallel to both the parallel side walls and the longitudinal axis of the socket support.

2. A connector according to claim 1 wherein a cover is connected to the socket support by screws.

3. A connector according to claim 1 wherein a cover is attached to the socket support by welding.

4. A connector according to claim 1 wherein a cover is attached to the socket support by heat staking.

5. A connector according to claim 2 wherein the socket supports are secured within the bezel retaining member by snap connectors.

6. A modular connector for data communication sockets comprising:

A. a socket support in the form of a substantially C-shaped channel extending lengthwise along a longitudinal axis and having parallel side walls joined by a bottom;

B. at least two socket members located in the socket support;

C. each socket member having a major axis and a minor axis;

D. a socket opening in each socket member; and

E. each socket opening having a longitudinal axis formed at a 90° angle with the major axis of the socket member in which it is formed, such that when the socket members are assembled in side by side relationship in the socket support, the longitudinal axes of the socket openings are in alignment with each other and parallel to both the parallel side walls and the longitudinal axis of the socket support;

F. at least one aperture in the bottom of the socket support through which wires connected to the socket members may pass;

G. two parallel rows of connector tabs projecting from the bottom of the socket support with each row connected to the wires of a respective one of the socket members;

H. a cover secured to the channel socket support and having apertures corresponding in number to the socket members through which apertures plugs may pass into the sockets; and I. a retaining member comprising a bezel having an opening for receiving and mounting therein at least three rows of said socket supports with their longitudinal axes parallel to one another, each socket support having at least two socket members arranged side by side.

* * * * *